US008752724B2

(12) United States Patent
Babikian et al.

(10) Patent No.: US 8,752,724 B2
(45) Date of Patent: Jun. 17, 2014

(54) INSERT FOR A CONTAINER

(75) Inventors: Dikran S. Babikian, Glendale, CA (US); Marvin C. Wells, Newbury Park, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 1296 days.

(21) Appl. No.: 11/787,279

(22) Filed: Apr. 16, 2007

(65) Prior Publication Data

US 2008/0251528 A1 Oct. 16, 2008

(51) Int. Cl.
*B65D 25/14* (2006.01)
*B65D 90/00* (2006.01)
*B65D 35/14* (2006.01)

(52) U.S. Cl.
USPC ..... 220/495.08; 220/908; 220/495.11

(58) Field of Classification Search
USPC ..... 220/495.08, 495.06, 495.11, 908, 220/908.1, 495.01, 737, 700–702, 23.87, 220/23.89, 910, 919; 248/97, 95; 141/390
See application file for complete search history.

(56) References Cited

U.S. PATENT DOCUMENTS

| | | | | |
|---|---|---|---|---|
| 1,688,242 | A | | 10/1928 | Lawrence et al. |
| 1,971,642 | A | | 8/1934 | Champlin |
| 2,127,607 | A | | 8/1938 | Levow |
| 3,768,763 | A | * | 10/1973 | Hembree ..... 248/97 |
| 4,140,257 | A | | 2/1979 | Peterson |
| 4,509,570 | A | * | 4/1985 | Eby et al. ..... 141/390 |
| 4,623,111 | A | * | 11/1986 | Prader ..... 248/97 |
| 4,921,195 | A | | 5/1990 | Clark et al. |
| 4,946,118 | A | | 8/1990 | Hastings |
| 5,065,891 | A | | 11/1991 | Casey |
| 5,605,891 | A | | 2/1997 | Prino et al. |
| 5,671,861 | A | | 9/1997 | Hall et al. |
| 5,816,431 | A | | 10/1998 | Giannopoulos |
| 6,085,647 | A | * | 7/2000 | Burow ..... 100/295 |
| 6,135,518 | A | | 10/2000 | Holthaus |
| 6,607,093 | B1 | | 8/2003 | Morad et al. |

(Continued)

FOREIGN PATENT DOCUMENTS

| | | |
|---|---|---|
| DE | 20 2004 014 632 U1 | 7/2005 |
| EP | 0 209 304 A1 | 1/1987 |
| FR | 2 125 063 | 9/1972 |

OTHER PUBLICATIONS

Written Opinion of the International Searching Authority for International Application No. PCT/US2008/056550, filed Mar. 11, 2008, Written Opinion dated Jul. 3, 2008 and mailed Jul. 11, 2008 (6 pgs.).

(Continued)

*Primary Examiner* — Bryon Gehman
*Assistant Examiner* — Shawn M Braden
(74) *Attorney, Agent, or Firm* — Christie, Parker & Hale, LLP

(57) ABSTRACT

A container system includes a container having an opening and an insert configured to be placed in the container through the opening. The insert includes a sleeve substantially corresponding in shape to a shape of an inner surface of the container adjacent to the opening.

38 Claims, 11 Drawing Sheets

(56) References Cited

U.S. PATENT DOCUMENTS

| | | | | |
|---|---|---|---|---|
| 6,612,457 | B1 * | 9/2003 | Caron | 220/480 |
| 6,739,114 | B2 * | 5/2004 | Shaffer | 53/449 |
| 7,107,934 | B1 * | 9/2006 | Hanks | 119/170 |
| D548,915 | S * | 8/2007 | Yang et al. | D34/6 |
| 7,252,207 | B2 * | 8/2007 | Liao | 220/495.11 |
| 2003/0098309 | A1 | 5/2003 | Liao | |
| 2004/0200843 | A1 | 10/2004 | Shalit | |
| 2006/0254951 | A1 * | 11/2006 | Yang et al. | 206/554 |
| 2007/0051743 | A1 | 3/2007 | Giwargis et al. | |

OTHER PUBLICATIONS

International Search Report for International Application No. PCT/US2008/056550, filed Mar. 11, 2008, International Search Report dated Jul. 3, 2008 and mailed Jul. 11, 2008 (2 pgs.).

English language translation of DE 20 2004 014632 to Baron listed above; 9 pages.

English language translation of FR 2 125 063 to Observa listed above; 5 pages.

Supplementary European Search Report issued for corresponding European Application No. 08754886.3 dated Oct. 28, 2013; 8 pages.

* cited by examiner 34
64
30
44
42
46
60
60
40
44
59
52
48
59
59
50
51
36
36
59
51
59
59
38

46
64
30
44
42
46
34
44
40
60
48
36
38

INSERT FOR A CONTAINER

BACKGROUND

The present application generally relates to an insert for containers, and more particularly, to an insert for a trash container.

Public bathrooms typically have paper towel dispensers and trash containers that are combined in a single wall mounted unit. An example of such a paper towel dispenser and trash container unit 10 is shown in FIG. 1. The paper towel dispenser 12 is positioned on top of the unit 10. Paper towels can be dispensed from an opening in a bottom panel 14 of the paper towel dispenser 12. Below the paper towel dispenser 12 is a trash container 16. The container 16 includes a front panel 18, a rear wall 20, side walls 22 and a bottom 24. The top of the container 16 is open to define an opening 26. The distance between the trash container 16 and the bottom panel 14 provides sufficient space so that users can pull paper towels out of dispenser 12 and place trash in the container 16 through the opening 26. The trash container 16 may have any shape. In FIG. 1, the trash container 16 is shown to be rectangular and have a curved front panel 18 so as to be more aesthetically pleasing.

Some trash containers may have an inner container for holding a trash bag. The bag is placed inside the container and the upper part of the bag is folded over and outside the top of the container. When the inner container and the bag are placed in the trash container, the inner container and the bag may be partially hidden from view such that the front wall of the trash container is unobstructed. Accordingly, a more aesthetically pleasing paper towel dispenser and trash container can be provided by concealing the bag with the use of the inner container.

To remove the bag when full, a maintenance person can pull the bag out of the inner container without removing the inner container from the trash container. Due to the vacuum created between the bag and the inner container and the friction between the bag and the inner container, the inner container may be pulled out with the bag. However, the inner container may not be completely or easily removable from the trash container because the paper towel dispenser is closely positioned above the trash container. Accordingly, the front panel of the wall mounted trash containers typically function as a door so as to allow access to the container through the front of the trash container. The door may be hinged on one side and latched or locked on the other side. A maintenance person can unlatch or unlock the door and remove the inner container for changing the bag and cleaning the inner container or the trash container.

Maintenance personnel often remove the inner container and simply put the trash bag inside the trash container to simplify the maintenance process. However, to secure the bag in the trash container, the bag is folded over the front panel of the trash container. Accordingly, part of the front panel of the trash container is covered by the bag, which is less aesthetically pleasing than when the inner container is properly used. Furthermore, removal of the bag without opening the front wall of the trash container may still prove cumbersome due to the above-described vacuum and friction between the bag and the trash container.

Based on the above, there is a need for an inner container or insert for a trash container that allows easy access to the bag and removal of the bag without having to open the front panel of the trash container.

SUMMARY

In accordance with one aspect of the disclosure, an insert assembly for a container includes a sleeve, which has a lower portion, an upper portion extending from the lower portion, the upper portion being tapered inwardly relative to the lower portion, a lip extending outwardly from an upper edge portion of the upper portion.

In accordance with another aspect of the disclosure, a container assembly includes a container having an opening and a bottom, and an insert which includes a sleeve and at least a first leg extending from the sleeve. A length of the sleeve and a length of the at least first leg substantially correspond to a distance between the opening and the bottom of the container.

In accordance with another aspect of the disclosure, a container and towel dispensing system includes a towel dispenser, and a container having an opening, the container spaced below the towel dispenser. The space between the top of the container and the bottom of the towel dispenser defines an access area to the opening. The container and towel dispensing system further includes an insert configured to be placed in the container through the opening, the insert comprising a sleeve.

DETAILED DESCRIPTION

Figure 1:
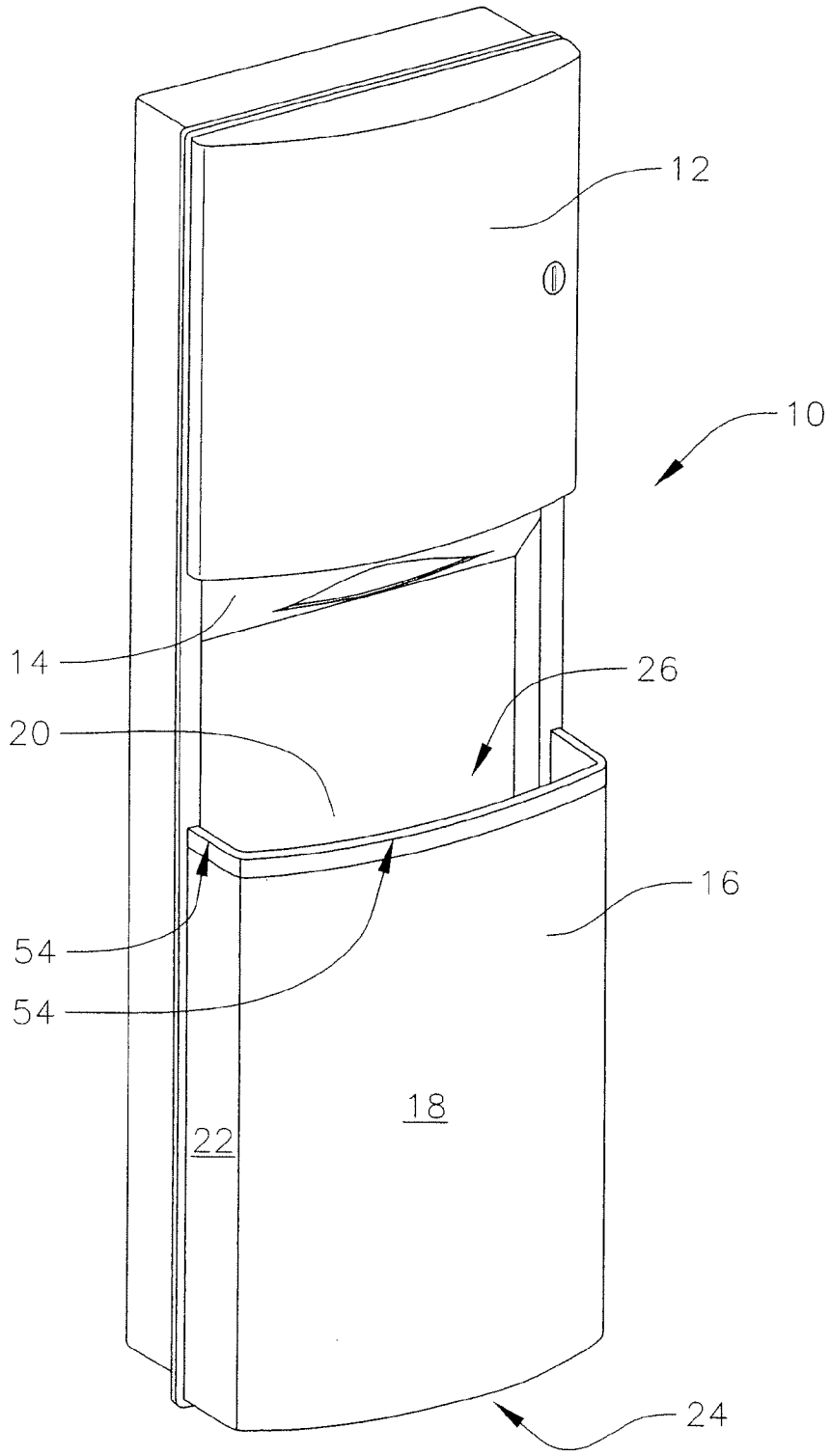
FIG. 1 PRIOR ART
FIG. 1 is a perspective view of a prior art wall mounted paper towel dispenser and trash container unit.

Referring to FIGS. 2-11, an insert 30 for use with a container is shown. The insert 30 includes a sleeve 34 that can be placed inside a container 16 in order to support a bag. Alternatively, the insert 30 may include one or more legs 36 extending from the sleeve 34 and may also include a base 38 connected to the one or more legs 36. As described in detail in the following, the insert 30 can be supported inside the container such the sleeve 34 is positioned near the opening 26 of the container 16.

A container as described herein and with which the insert can be used may be any type of container that is used to hold a bag. For example, the container may be a trash container, a laundry bin or the like. The container may be any type of container such as a self supported standalone trash container, a wall mounted standalone trash container, a counter mounted standalone trash container, or a wall mounted container having a paper towel dispenser disposed above the container. Any one of the noted wall mounted containers may be fully recessed in the wall, partially recessed in the wall, or fully protruding outward from the wall. To describe aspects of the disclosure, the trash container 16 of FIG. 1 is described for use with the insert 30. However, one of ordinary skill in the art will appreciate that the insert 30 of the disclosure can be used with any type of container whether standalone or part of a container/towel dispensing system.

Figure 2:
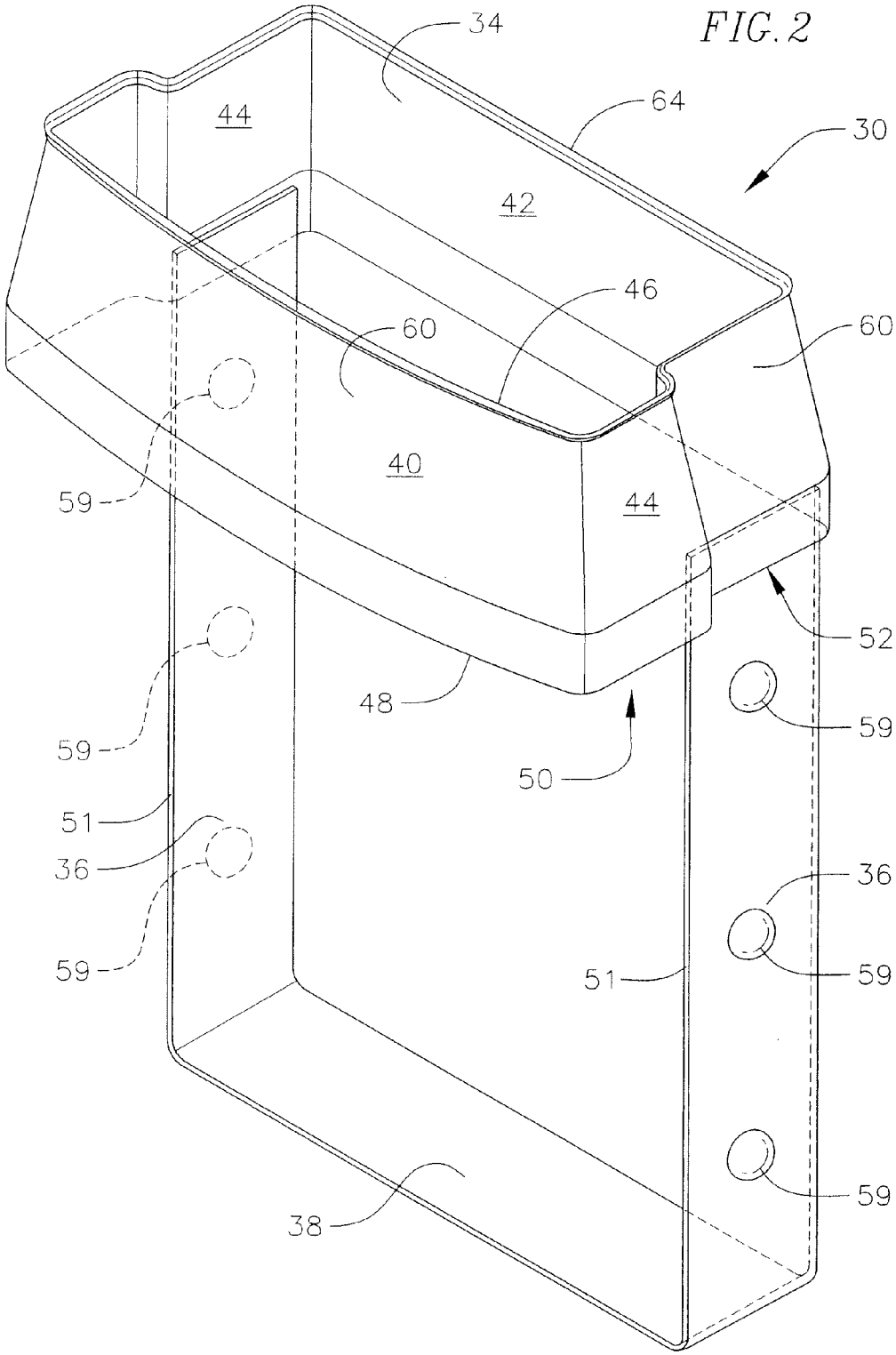
FIG. 2 is a perspective view of an embodiment of an insert for a container according to the present disclosure.
Figure 3:
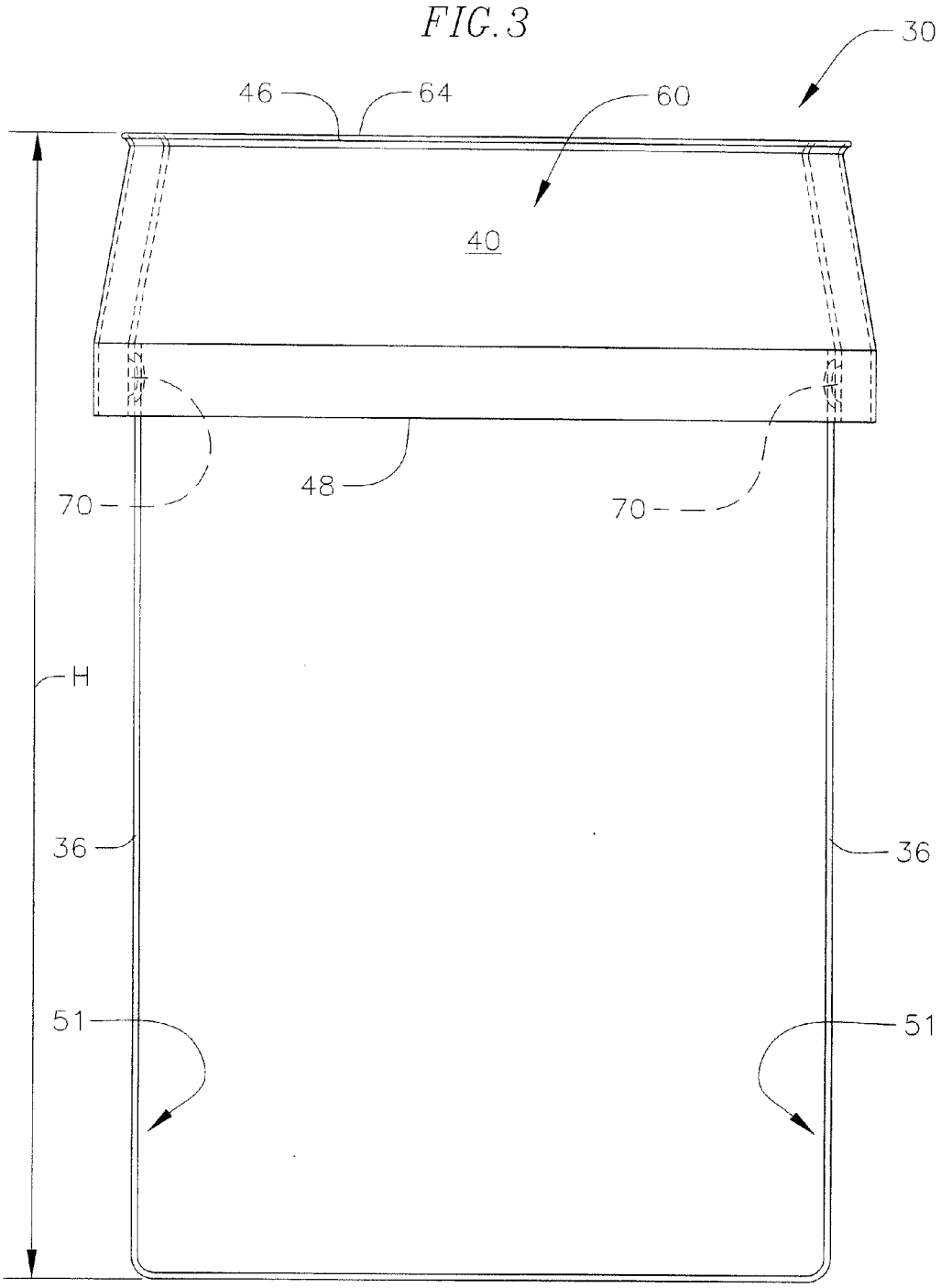
FIG. 3 is a front view of the insert of FIG. 2.

The sleeve 34 may include a front wall 40, a rear wall 42 and a pair of side walls 44, each of which may take any shape so as to define an overall shape for the sleeve 34. For example, any of the front wall 40, the rear wall 42, or the side walls 44 can be flat or curved. The shape of the sleeve 34 can correspond to the shape of an inner surface of a container adjacent to the opening of the container. Thus, as shown in FIG. 2, the front wall 40 is curved in a similar fashion as the front panel 18 of the container 16 since the insert 30 is for use with the container 16. The size of the sleeve 34 is such that when the insert 30 is fully placed in the container 16, all or portions of the outer surface of the sleeve 34 can be in contact with or in close proximity to the inner surface of the container 16. The sleeve 34 includes an upper edge 46 and a lower edge 48. The upper edge 46 is positioned at or slightly above or below the opening 26 when the insert 30 is fully placed in the container 16. The sleeve 34 is described and shown in FIGS. 2-11 to have continuous front wall 40, rear wall 42 and side walls 44 that are connected to define a fully peripheral sleeve 34. However, the sleeve 34 may include opening or gaps (not shown) in any of the front wall 40, rear wall 42 and side walls 44. The openings or gaps may be such that any of the front wall 40, rear wall 42 and side walls 44 are disconnected from an adjacent wall so as to provide a partially peripheral sleeve 34 rather than a fully peripheral sleeve 34.

Figure 8:
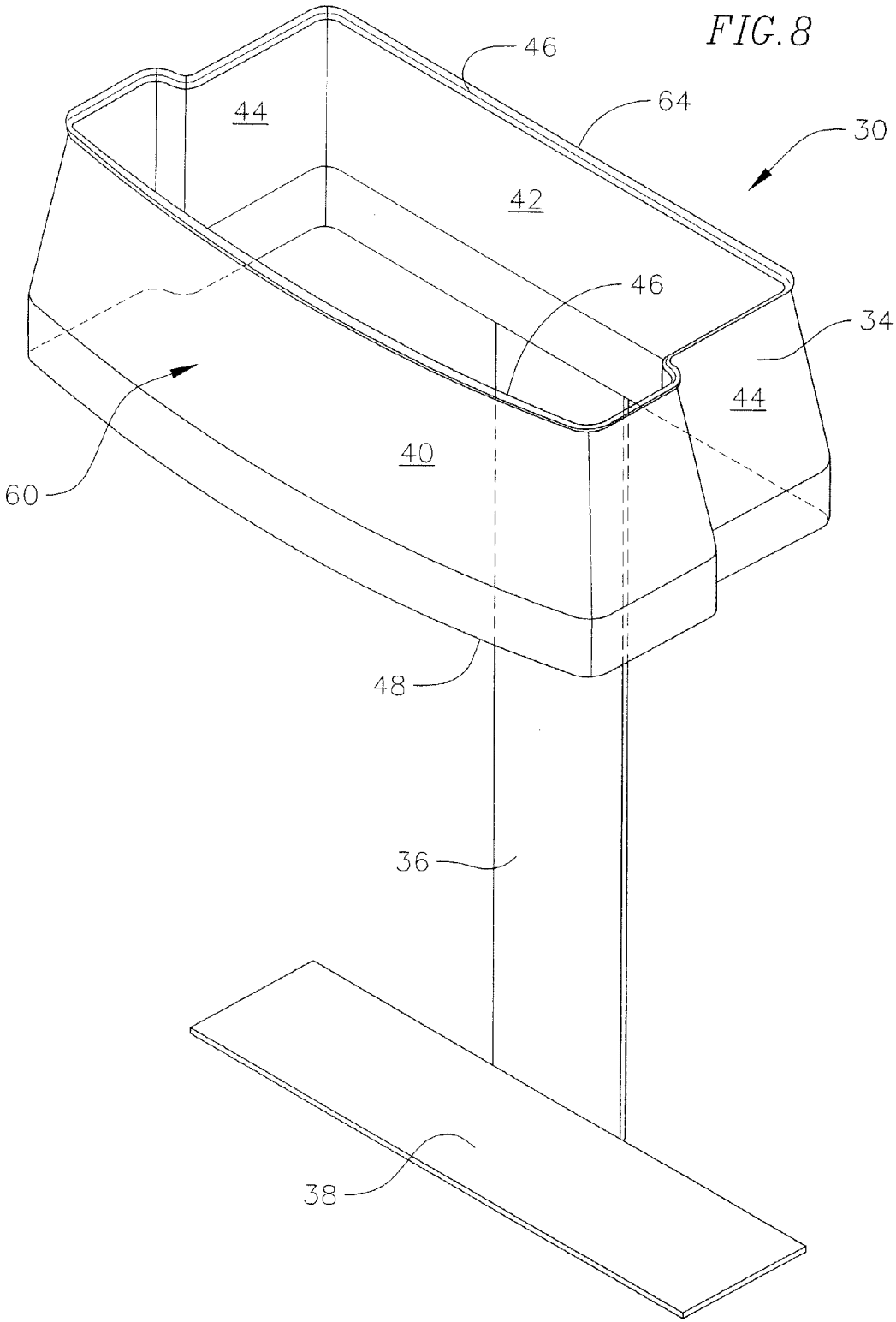
FIG. 8 is a perspective view of another embodiment of an insert for a container according to the present disclosure.
Figure 9:
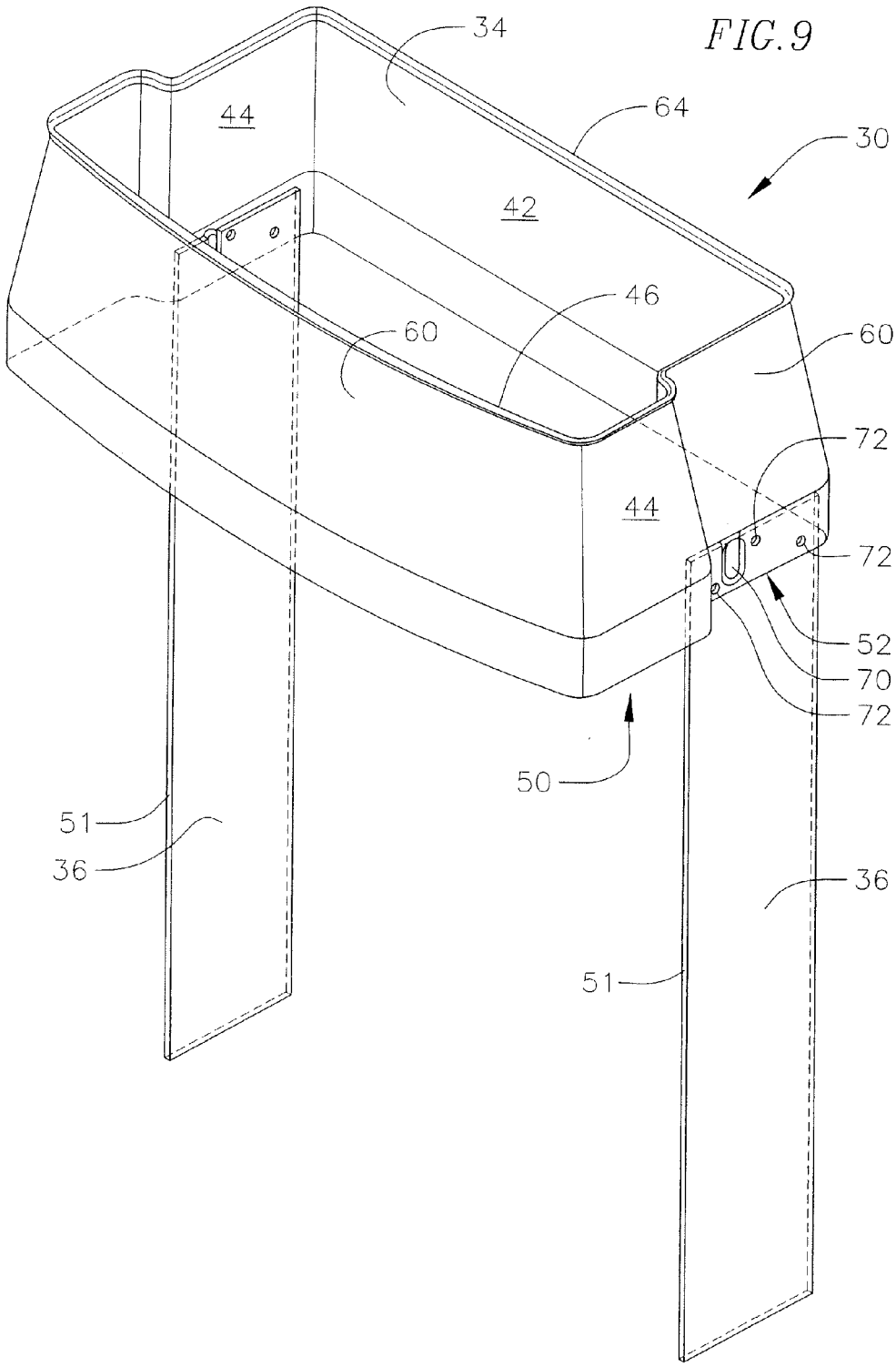
FIG. 9 is a perspective view of another embodiment of an insert for a container according to the present disclosure.

In accordance with aspects of the disclosure, the insert 30 may include one or more legs 36 extending from the sleeve 34. In accordance with aspects of the disclosure, the insert 30 may also include a base 38 that extends from the one or more legs 36. Referring to FIG. 2, an insert 30 is shown as having two legs 36 and a base 38 connecting the legs. Alternatively, as shown in FIG. 8, the insert 30 may include only one leg 36 and a base 38. Alternatively yet, as shown in FIG. 9, the insert 30 may include a pair of legs 36 without having a base 38. Accordingly, the insert 30 can have any number of legs with or without having a base.

Referring back to FIG. 2, the legs 36 are connected to the side walls 44 and extend downward from the side walls 44. The base 38 connects and structurally supports the legs 36. The height of the sleeve 34, which is the distance from the upper edge 46 to the lower edge 48, and the distance from the lower edge 48 to the bottom of the base 18 define an overall height H of the insert 30. To provide full insertion of the insert 30 in the container 16 such that the upper edge 46 is at or slightly below or above the opening 26, which may be referred to herein as the first position, the overall height H is nearly equal to the depth of the container 16.

Figure 4:
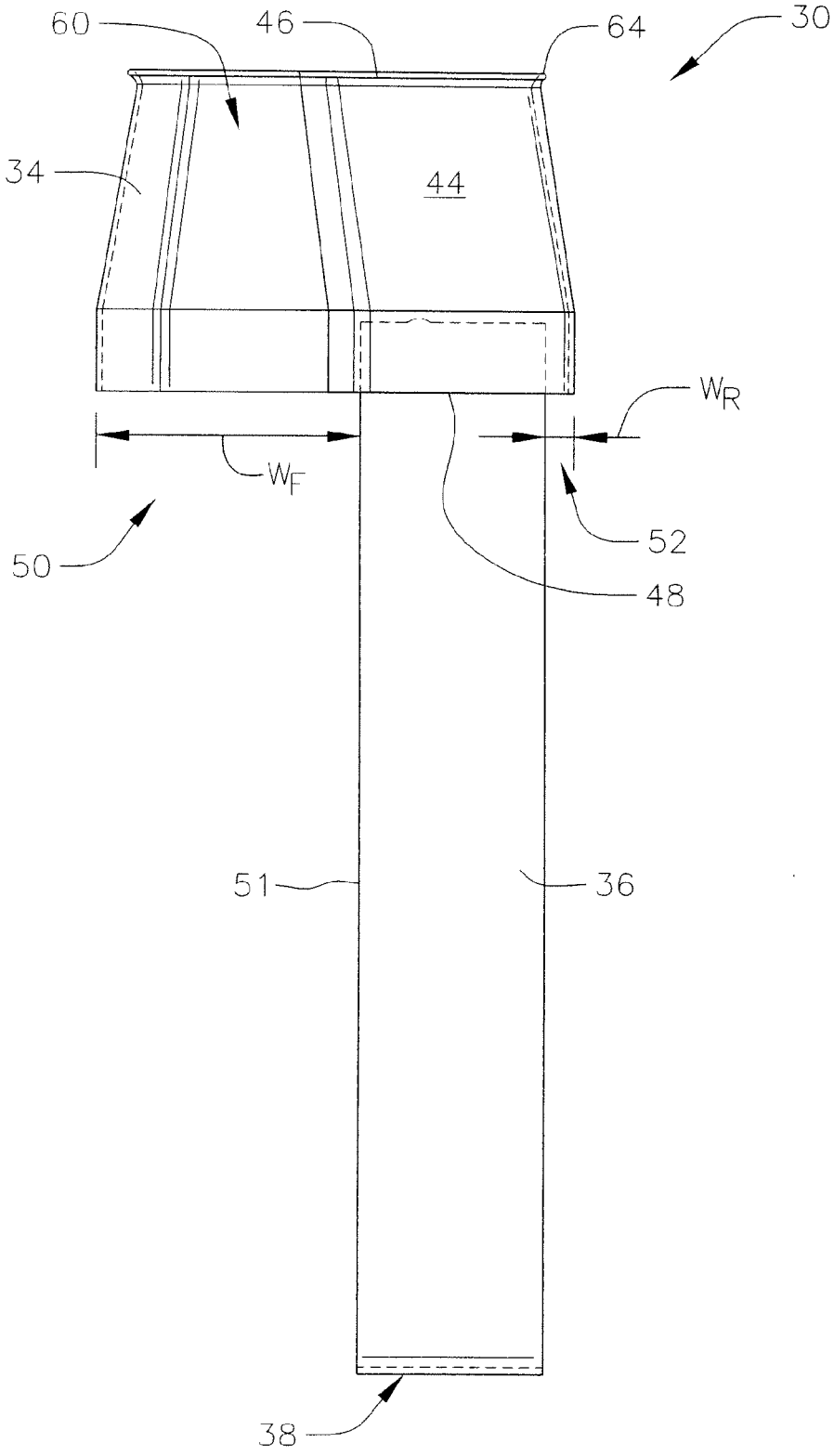
FIG. 4 is a side view of the insert of FIG. 2.
Figure 5:
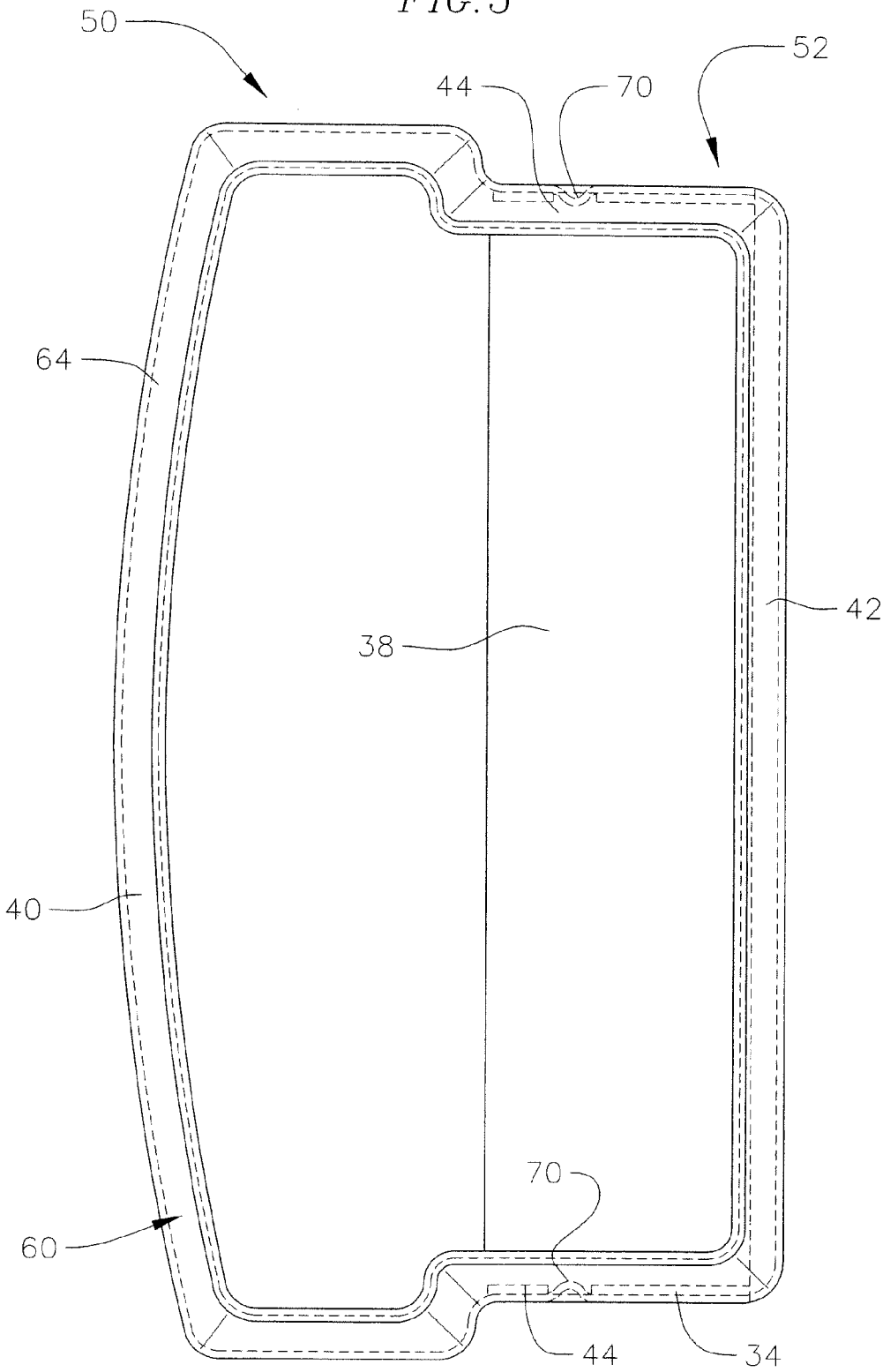
FIG. 5 is a top view of the insert of FIG. 2.
Figure 6:
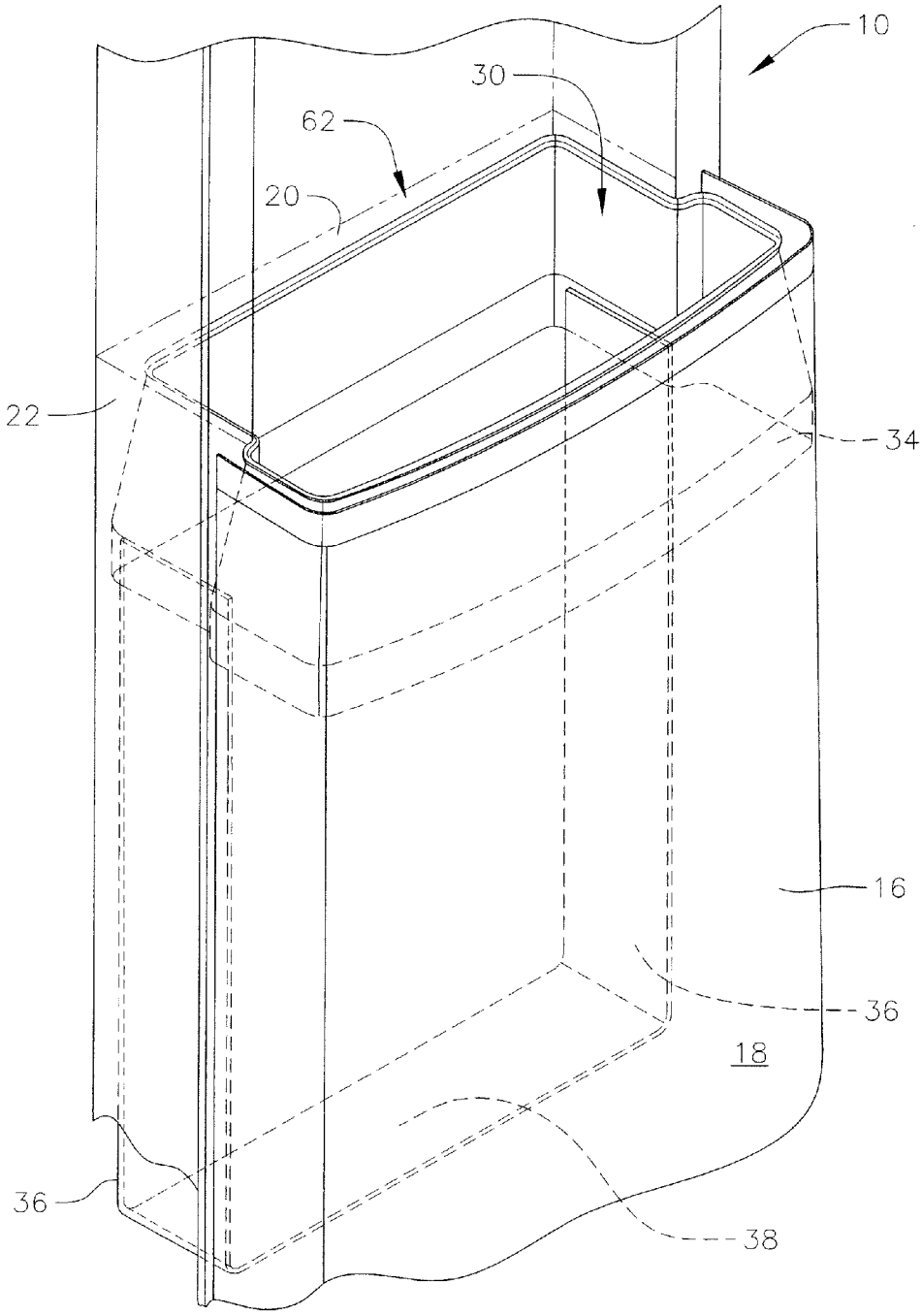
FIG. 6 is a fragmentary perspective view of the insert of FIG. 2 placed in the trash container of FIG. 1.
Figure 7:
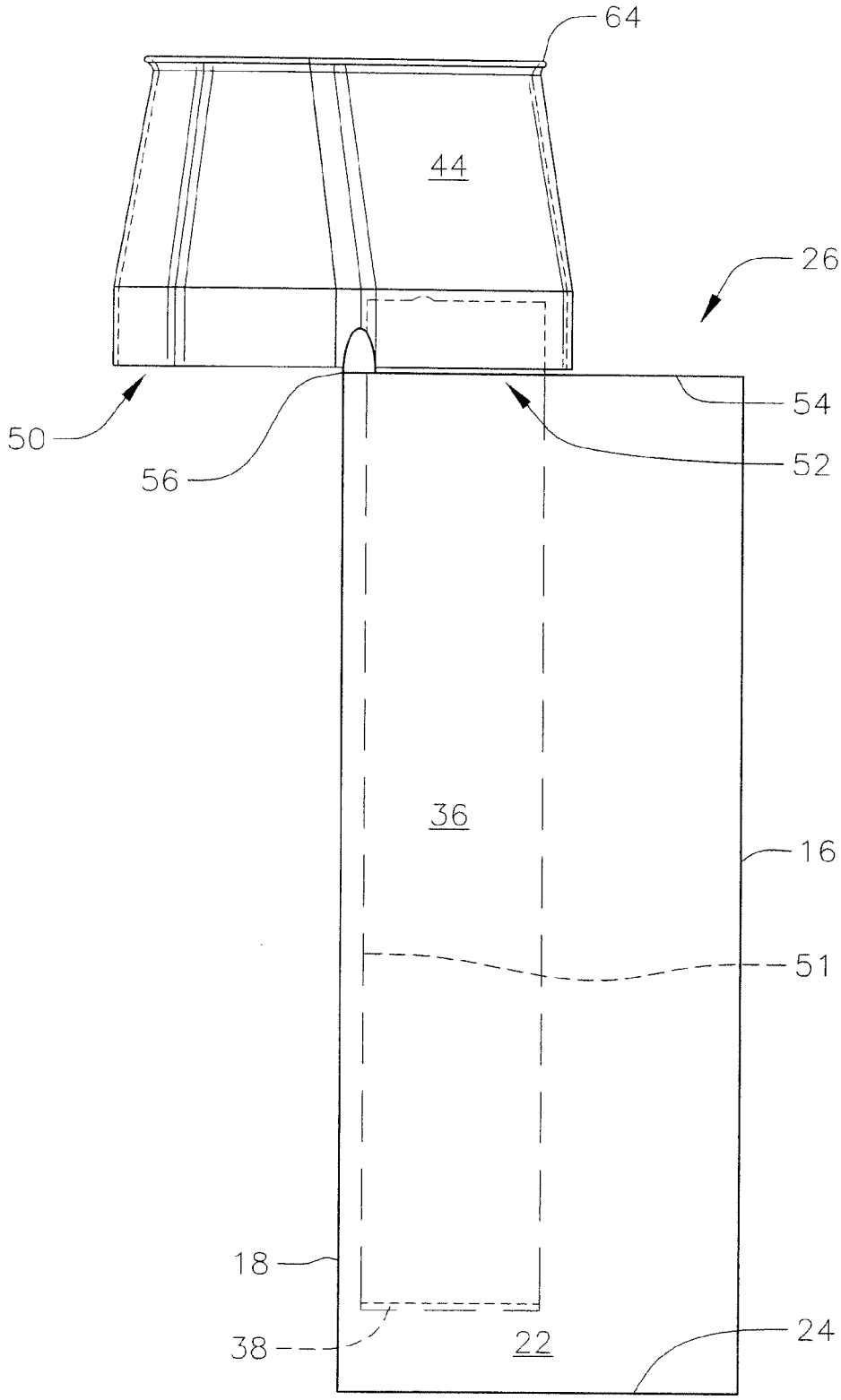
FIG. 7 is a schematic side view of the insert of FIG. 2 shown placed on the trash container of FIG. 1.

The legs 36 are smaller in width than the width of the side walls 44 of the sleeve 34. Additionally, the legs 36 are connected to the side walls 44 so as to be spaced apart from the front panel 18 and the rear wall 20 of the container 16 when the insert 30 is fully placed in the container 16. The legs 36 divide the lower edge 48 of the sleeve 34 into a front portion 50 and a rear portion 52. As shown in FIG. 4, the front portion 50 has a larger width $W_F$ that the width $W_R$ of the rear portion 52. Accordingly, as shown in FIG. 7, when the insert 30 is partially pulled out of the container 16 such that the sleeve 34 is above the opening 26, the insert 30 can be moved forward so that front edges 51 of the legs 36 contact the inner surface of the front panel 18 of the container 16. Additionally in this position, a substantial part of the front portion 50 of the lower edge 48 is positioned forward of the front panel 18 of the container 16. In this position, the front portion 50 of the lower edge 48 can be placed on the front edge 54 of the opening 26 to rest the insert 30 in this position, which may be referred to herein as the second position. Thus, in the second position, the sleeve 34 is above and forward of the opening 26, and the front portion 50 of the lower edge 48 is engaged with the front edge 54 of the opening 26. Because the sleeve 34 is above and forward of the opening 26 in the second position, an operator can easily place a new bag inside the container 16 and around the sleeve 34, as described in detail below.

Referring to FIG. 7, to secure the sleeve 34 in the second position, the sleeve 34 can include notches 56 in the front portion 50 that are configured to receive portions of the front edge 54 of the opening. The notches 56 can be anywhere on the front portion 50 of the lower edge 48. In the insert 30 shown in FIG. 4, the notches 56 are on the front portion 50 near the legs 36 so as to receive a portion of the front edge 54 of the container 16. Although not shown, other type of fastening mechanisms such as hooks, pins that engage correspondingly sized holes, or the like can be used to secure the sleeve 34 in the second position.

The outer sides of the legs 36 and any portion of the outer surface of the sleeve 34 that may contact the inner surface of the container 16 can frictionally engage the corresponding inner surfaces of the container 16 to provide resistance when the insert 30 is being pulled out of the container 16. Such resistance may prevent the insert 30 from being lifted out of the container 16 along with a bag that is being pulled out of the container 16 by an operator. The frictional engagement of the sleeve 34 with the container 16 may be facilitated by abrasions, dimples, bumps, and/or other frictional enhancing structures one or both of the insert 30 and the inner surfaces of the container. In FIG. 2, bumps 59 are shown on the outside surfaces of the legs 36.

The sleeve 34 is shaped and sized to closely correspond with the shape and size of the opening 26 of the container 16. Accordingly, when the insert 30 is in the first position, i.e., fully placed in the container 16, an opening to the container 16 is provided by the sleeve 34 which is slightly smaller than the opening 26 of the container 16. All or portions of the sleeve 34 may be tapered to include a tapered portion 60 so as to provide a tapered gap 62 (shown in FIG. 6) between the sleeve 34 and the container 16. In the sleeve 34 that is shown in FIGS. 2-8, the tapered portion 60 encompasses a large portion of the sleeve 34. The gap 62 allows a maintenance person to tuck the open end portion of a bag into the gap 62. Additionally, the gap 62 allows a maintenance person to reach therein to pull out the open end portion of the bag in order to remove the bag from the container 16. The upper edge 46 of the sleeve 34 may include a lip 64 that can function as a finger hold or hand hold in order for a maintenance person to grab and move the insert 30. Additionally, the lip 64 functions as a stop in order to prevent the bag when full from falling into the container 16 once the bag is tied around the outer perimeter of the sleeve 34 with a knot, an elastic band or other restraining device. The lip 64 may be a single peripheral lip that extends around all or portions of the upper edge 46 of the sleeve 34. The lip 64 may also include a plurality of lip segments that extends around all or portions of the upper edge 46 of the sleeve. Additionally, the lip 64 may be disposed below the upper edge 46 of the sleeve 34 on the tapered portion 60.

In order to provide efficient storage or shipping of multiple inserts 30, the sleeve 34 is shaped to provide stacking of one insert 30 into another. The legs 36 may be slightly tapered outward to facilitate the stacking of the sleeves 34. Additionally, any hooks, clips or other attachment devices described below in order to place the sleeve 34 in the container 16 can be separate items and not part of the sleeve 34 so as to allow stacking of the sleeves 34.

In operation, when the bag in the container 16 becomes full, a maintenance person can use three methods for removing and replacing the bag. With the first method, the maintenance person can close the bag and lift the bag out of the insert 30 without removing the insert 30 from the container 16. Because the insert 30 is not in the form of a closed container and gaps are provided between the insert 30 and the container 16, the bag can be lifted out without encountering a significant amount of resistance caused by vacuum between the bag and the container 16 or friction between the bag and the container 16. The maintenance person can then place a new bag in the container 16 and tuck the open end portions of the bag into the gap 62. With the second method, the bag can be removed from the container 16 in a similar fashion as the first method. However, as shown in FIG. 7, to place a new bag in the container 16, the maintenance person can place the insert 30 in the second position. To do so, the maintenance person can lift the insert 30 out of the container (e.g., by grabbing or holding the lip 64) and rest the front portion 50 of the lower edge 48 on the edge 54 of the opening 26. The maintenance person can also place the notches 56 over the edge 54 of the opening to secure the insert 30 in the second position. While in the insert 30 is in the second position, a new bag can be fitted over the insert 30 such that the edge portions of the open end of the bag are folded over the sleeve 34. The insert 30 along with the bag can then be placed in the first position, i.e., fully inside the container 16. Similar to the first method, to further complete the installation of the bag over the insert 30, if necessary, the maintenance person can then tuck the edge portions of the open end of the bag into the gap 62. With the third method, the maintenance person can completely lift the bag and the insert 30 out of the container 16 and remove the bag from the insert 30. To place a new bag in the container 16, the maintenance person can place the insert 30 either back inside the container 16 or in the second position as described above. To further complete the installation of the bag over the insert 30, if necessary, the maintenance person can then tuck the edge portions of the open end of the bag into the gap 62.

The insert 30 of FIGS. 2-7 is shown to have two legs 36 that are attached to the side walls 44 of the sleeve 34. However, the insert 30 can include only one leg 36 or more than two legs 36. For example, as shown in FIG. 8, the insert 30 can include only one leg 36 that extends from the rear wall 42 of the sleeve 34 at or near the midpoint of the rear wall 42. The base 38 is attached to the leg 36 such that the leg 36 and the base 38 form a T. Thus, one of ordinary skill in the art will readily appreciate than a variety of structures are possible for the legs 36 and the base 38 in order to provide the functionality of the insert 30 as disclosed.

Referring to FIG. 9 the insert 30 includes one or more legs 36 but does not include a base 38. The height of the sleeve 34, which is the distance from the upper edge 46 to the lower edge 48, and the distance from the lower edge 48 to the bottom of the legs 36 define an overall height H of the insert 30. To provide full insertion of the insert 30 in the container 16 such that the upper edge 46 is at or slightly below or above the opening 26, the overall height H is nearly equal to the depth of the container 16. Additionally, the legs 36 can contact the bottom 24 of the container to support the insert 30 inside the container 16.

Figure 10:
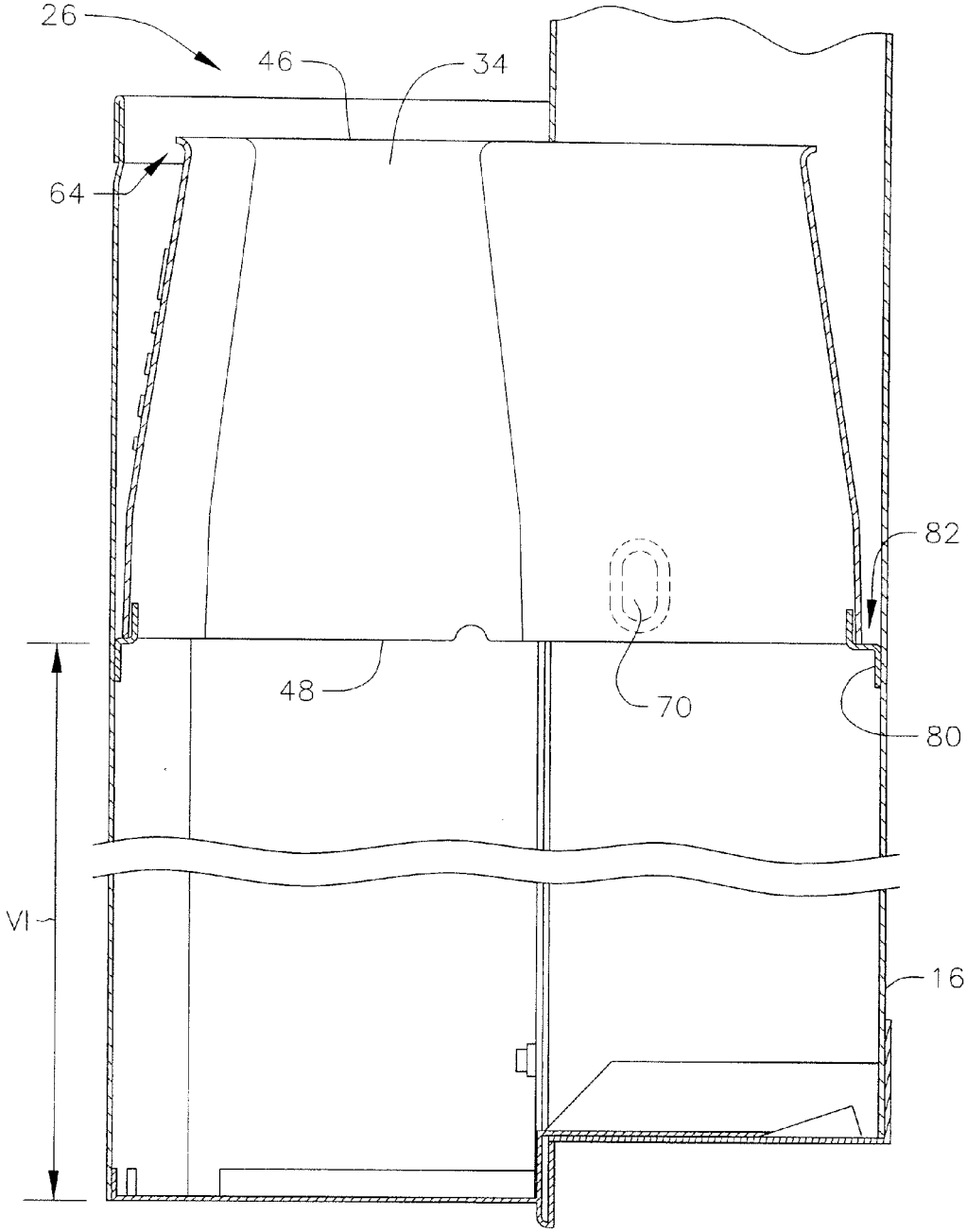
FIG. 10 is a side view of another embodiment of an insert for a container according to the present disclosure.
Figure 11:
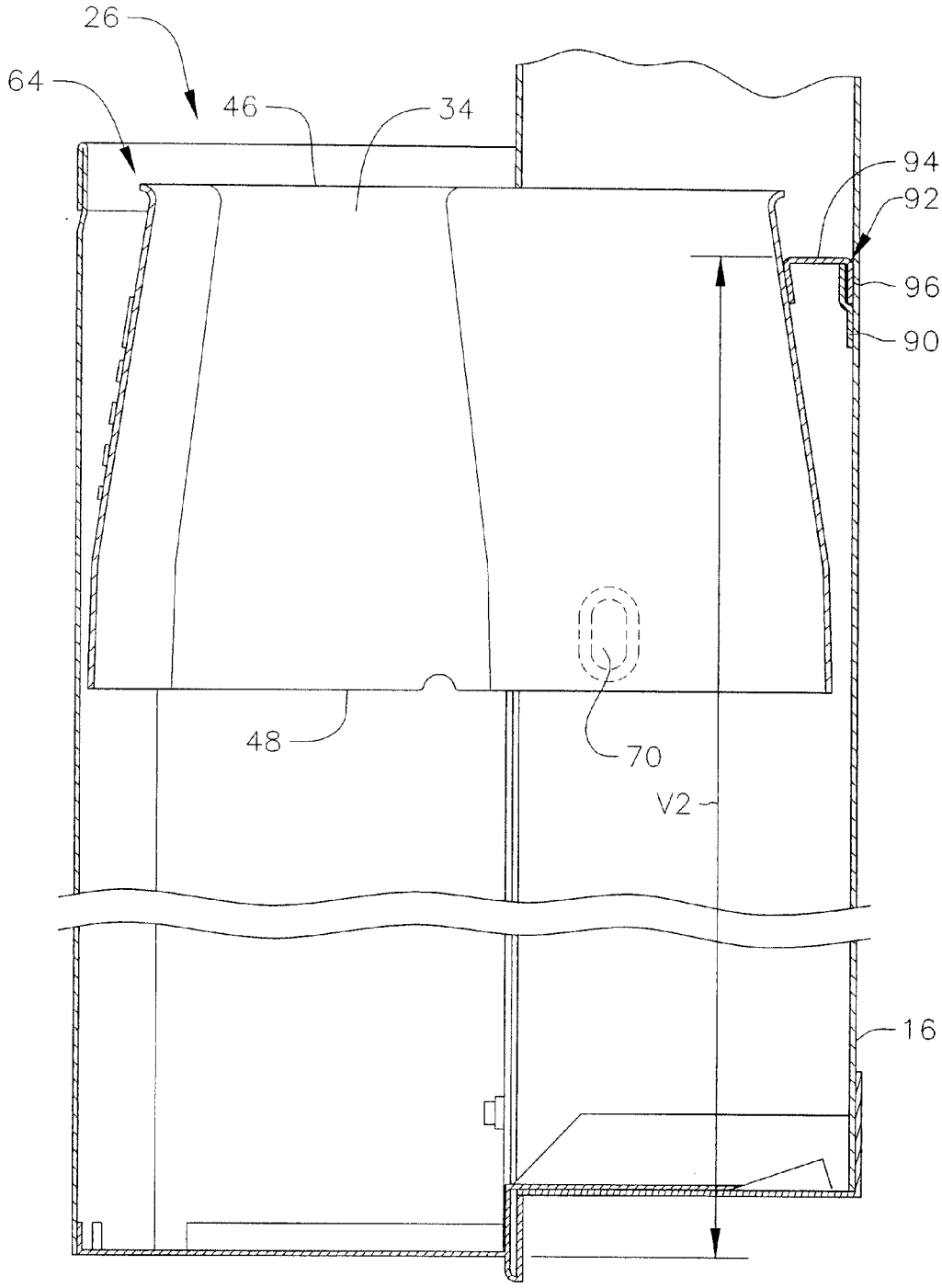
FIG. 11 is a side view of another embodiment of an insert for a container according to the present disclosure.

Referring to FIGS. 10 and 11, the insert 30 may only include the sleeve 34 but not include any legs or a base. The insert 30 can be supported in the container 16 by coupling with a portion of an inner wall of the container 16. This coupling may be with fasteners, clips, hooks, brackets, Velcro®, or other types of coupling devices. An example of such a coupling device is shown in FIG. 10, where the container 16 includes one or more Z-shaped brackets 80 mounted on the inner wall of the container 16. Each Z-shaped bracket 80 is oriented such that a support surface 82 is provided near the inner wall of the container 16. When the insert 30 is placed in the container 16, one or more portions of the lower edge 48 of the sleeve 34 can rest on the support surface 82 to support the insert 30 inside the container. Accordingly, a vertical position V1 of the Z-shaped brackets 80 provides positioning of the upper edge 46 of the sleeve 34 at or near the opening 26 of the container 16. The container 16 may include a pair of Z-shaped brackets 80 positioned on the inner wall of the container 16 opposite to each other at the vertical position V1. The container 16 may include more than two Z-shaped brackets 80 disposed along the inner wall of the container 16 at the vertical position V1. Also, the container 16 may be a single Z-shaped bracket 80 that extends along the entire perimeter of the inner wall of the container 16 at the vertical position V1.

Referring to FIG. 11, another example of the coupling between the sleeve 34 and the inner wall of the container 16 is shown. The container 16 includes a Z-shaped bracket 90 mounted on the inner wall of the container 16. The Z-shaped bracket 90 provides a space 92 between the inner wall of the container 16 and the bracket 90. The sleeve 34 includes a U-shaped bracket 94 having an outer plate 96. The width of the space 92 is slightly larger than the thickness of the outer plate 96. Accordingly, the outer plate 96 can be inserted in the space 92. When the insert 30 is placed in the container 16, the outer plate 96 of the U-shaped bracket 94 is inserted in the space 92. Therefore, the coupling of the Z-shaped bracket 90 and the U-shaped bracket 94 maintains the sleeve 34 at a vertical position V2 in the container 16. The position V2 can be determined so that the upper edge 46 of the sleeve 34 is positioned near the opening 26 of the container 16. In FIG. 11, only one Z-shaped bracket 90 and one U-shaped bracket 94 are shown. However, any number of such brackets can be used to hold the sleeve 34 in the container 16.

In another embodiment, the interior of the container 16 can be tapered inwardly is inwardly tapered such that the bottom of the sleeve 34 can frictionally lock against the inner wall of the container 16 as the sleeve 34 is inserted deeper into the container 16. If the insert 30 includes one or more legs 36, the inwardly tapered interior of the container 16 can provide frictional locking between the legs 36 and the inner wall of the container 16 as the one or more legs 36 are inserted deeper into the container 16.

The insert can be constructed in one-piece or in multiple parts. For example, the legs 36 can be separate parts that are attached to the sleeve 34 by fasteners, welding, force fitting of complementary portions of the legs 36 and the sleeve 34, or other known attachment methods. For example, the legs 36 are shown in FIG. 9 to be connected to the sleeve 34 by a snap/fit connection 70 (also shown in FIGS. 3, 5, 10 and 11) and a number of holes 72 that may represent welds or fasteners. The insert 30 can also be constructed in one-piece from a plastic material by molding methods that are known. The insert 30 can be constructed from suitable materials, such as plastic materials. An example of such a plastic material is Polyethylene.

While a particular form of the disclosure has been illustrated and described, it will be apparent that various modifications can be made without departing from the spirit and scope of the disclosure. Accordingly, it is not intended that the disclosure be limited, except as by the appended claims.

What is claimed is:

1. A container assembly comprising:

a bag having an open end portion;

a container mounted to a wall and having an edge defining an opening; and an insert for receiving the bag, the insert comprising:

a sleeve comprising:

a pair of spaced apart first walls;

a pair of spaced apart second walls extending between the first walls, said second walls being spaced apart by a first length; and a lower edge and an upper edge, and a base below the lower edge having a second length in the direction of the first length, wherein the second length is shorter than the first length;

wherein the insert is moveable from a first position wherein the insert is inside the container to a second position wherein the insert is partially removed from the container and at least a portion of the base is within the container, the base being moveable along the container in a direction along the first length, and at least a portion of the lower edge of the sleeve being positioned on the edge of the opening of the container when the insert is in the second position; and wherein the container maintains the insert in the second position;

wherein the open end portion of the bag extends over the upper edge of the sleeve; and wherein the base is located outside of the bag.

2. The container assembly of claim 1, wherein the insert further comprises at least a first leg extending below the lower edge.

3. The container assembly of claim 2, wherein the container includes a bottom surface, and wherein when the sleeve is placed in the container such that the base contacts the bottom surface of the container, the upper edge of the sleeve is located at or slightly below or above the edge defining the opening of the container.

4. The container assembly of claim 2, wherein the base is a lower end of at least one leg of said at least a first leg.

5. The container assembly of claim 2, wherein the base extends from the at least a first leg in a direction transverse to the at least a first leg.

6. The container assembly of claim 2, further comprising a second leg extending below the lower edge of the sleeve, wherein each of the first leg and the second leg extends below a corresponding first wall.

7. The container assembly of claim 6, wherein each of the second walls is longer than any of the first walls, and wherein all of the legs of the insert are closer to one of the second walls than the other second wall.

8. The container assembly of claim 6, wherein all of the legs are located in the container in the second position.

9. The container assembly of claim 1, wherein the lower edge of the sleeve comprises a notch for receiving the edge of the opening of the container.

10. The container assembly of claim 1, wherein the sleeve is stackable with another sleeve.

11. The container assembly of claim 1, wherein the sleeve is inwardly tapered between the lower edge and the upper edge in a direction from the lower edge to the upper edge.

12. The container assembly of claim 1, wherein the sleeve comprises a lip extending outwardly from the upper edge of the sleeve.

13. A container and towel dispensing system comprising:

a towel dispenser comprising an enclosure for holding paper towels and an opening providing access to the paper towels;

a container below the towel dispenser and defining an opening facing the towel dispenser;

an insert for receiving a bag, the insert comprising:

a sleeve comprising:

a pair of spaced apart first walls;

a pair of spaced apart second walls extending between the first walls, said second walls being spaced apart by a first length;

a lower edge and an upper edge, and a base for being located outside of the bag and below the lower edge having a second length in the direction of the first length, wherein the second length is shorter than the first length;

wherein the insert is moveable between a first position wherein the sleeve insert is inside the container, a second position wherein the insert is partially removed from the container, the sleeve is positioned on an edge of the opening of the container and the base is moved along the container in a direction along the first length, and a third position wherein the insert is fully removed from the container; and wherein the insert is movable through the opening of the container from the first position to the third position.

14. The container and towel dispensing system of claim 13, wherein the insert comprises at least a first leg extending from the sleeve.

15. The container and towel dispensing system of claim 14, wherein the container includes an edge defining the opening and a bottom surface, and wherein when the sleeve is placed in the container such that the base contacts the bottom surface of the container, the upper edge of the sleeve is, located at or slightly below or above the edge defining the opening of the container.

16. The container and towel dispensing system of claim 14, wherein the base extends from the at least first leg in a direction transverse to the at least first leg.

17. The container and towel dispensing system of claim 14, further comprising a second leg extending from the lower edge of the sleeve, wherein each of the first leg and the second leg extends below a corresponding first wall.

18. The container and towel dispensing system of claim 17, wherein each of the second walls is longer than any of the first walls, and wherein all of the legs of the insert are closer to one of the second walls than the other second wall.

19. The container and towel dispensing system of claim 14, wherein the base is a lower end of at least one leg of said at least a first leg.

20. The container and towel dispensing system of claim 13, wherein the lower edge of the sleeve comprises a notch for receiving the edge of the opening of the container.

21. The container and towel dispensing system of claim 13, wherein the sleeve is stackable with another sleeve.

22. The container and towel dispensing system of claim 13, the sleeve comprising a lip extending outwardly from the upper edge.

23. The container and towel dispensing system of claim 13, further comprising a bag located inside the sleeve.

24. The container and towel dispensing system of claim 13, wherein an inner wall of the container comprises an inner projection for engaging the sleeve to support the sleeve in the container.

25. The container and towel dispensing system of claim 24, wherein the inner projection comprises any one of a fastener, a clip, a bracket, and a hook and loop fastener.

26. The container and towel dispensing system of claim 24, wherein the sleeve comprises an outer projection for engaging the inner projection of the container.

27. The container and towel dispensing system of claim 26, wherein the outer projection comprises any one of a fastener, a clip, a bracket, and a hook and loop fastener.

28. The container and towel dispensing system of claim 13, wherein the sleeve is inwardly tapered from the lower edge to the upper edge in a direction from the lower edge to the upper edge.

29. A container and towel dispensing system comprising:

a towel dispenser comprising an enclosure for holding paper towels and an opening providing access to the paper towels;

a container below the towel dispenser and defining an opening facing the towel dispenser;

an insert comprising:

a sleeve for receiving a bag there-through, the sleeve comprising:

a pair of spaced apart first walls;

a pair of spaced apart second walls extending between the first walls; and a lower edge and an upper edge opposite the lower edge;

wherein the insert is moveable between a first position wherein the insert is inside the container, a second position wherein the insert is partially removed from the container and at least a portion of the lower edge of the sleeve is positioned on the edge of the opening of the container and a portion of each of said first walls extend transversely beyond the opening and a portion of each of said first walls extend axially above the opening, and a third position wherein the insert is fully removed from the container; and wherein the insert is movable through the opening of the container from the first position to the third position, and wherein an inner wall of the container comprises an inner projection for engaging the sleeve to support the sleeve in the container.

30. The container and towel dispensing system of claim 29, wherein the inner projection comprises any one of a fastener, a clip, a bracket, and a hook and loop fastener.

31. The container and towel dispensing system of claim 29, wherein the sleeve comprises an outer projection for engaging the inner projection of the container.

32. The Container and towel dispensing system of claim 31, wherein the outer projection comprises any one of a fastener, a clip, a bracket, and a hook and loop type fastener.

33. The container and towel dispensing system of claim 29, wherein the insert further comprises at least a leg extending below the lower edge of the sleeve.

34. The container and towel dispensing assembly of claim 29, wherein the insert further comprises a base below the lower edge of the sleeve.

35. A container assembly comprising:

a container mounted to a wall and having an edge defining an opening; and an insert for receiving a bag, the insert comprising:

a sleeve comprising:

a pair of spaced apart first walls;

a pair of spaced apart second walls extending between the first walls, said second walls being spaced apart by a first length; and a lower edge and an upper edge, and a base below the lower edge having a second length in the direction of the first length, wherein the second length is shorter than the first length;

wherein the insert is moveable from a first position wherein the insert is inside the container to a second position, wherein the insert is partially removed from the container and at least a portion of the base is within the container, the base being moveable along the container in direction along the first length, and at least a portion of the lower edge of the sleeve being positioned on the edge of opening of the container when the insert is in the second position; and wherein the container maintains the insert in the second position.

36. The container assembly of claim 35, wherein the insert further comprises at least a leg extending below the lower edge of the sleeve.

37. The container assembly of claim 36, wherein the base is a lower end of at least one leg of said at least a leg.

38. The container assembly of claim 35, further comprising a bag located inside the sleeve.

* * * * *